United States Patent [19]

Frey et al.

[11] 4,068,586

[45] Jan. 17, 1978

[54] CYLINDER FOR CLAMPING PRINTING PLATES

[75] Inventors: Rudolf Frey, Dirmstein; Joachim Bernauer, Frankenthal; Pirmin Göbel, Lambsheim, all of Germany

[73] Assignee: Albert Frankenthal AG, Frankenthal, Germany

[21] Appl. No.: 730,398

[22] Filed: Oct. 7, 1976

[30] Foreign Application Priority Data

Oct. 8, 1975 Germany ..... 2545124

[51] Int. Cl.[2] ..... B41F 21/06

[52] U.S. Cl. ..... 101/415.1

[58] Field of Search ..... 101/415.1, 378, 169, 101/157, 382, 383

[56] References Cited

U.S. PATENT DOCUMENTS

| | | | |
|---|---|---|---|
| 1,461,068 | 7/1923 | Regensteiner | 101/169 UX |
| 1,958,299 | 5/1934 | Ericksson | 29/117 |
| 2,157,621 | 5/1939 | Neilson | 101/415.1 |
| 2,621,592 | 12/1952 | Faeber | 101/415.1 |
| 2,900,904 | 8/1959 | Hanscho | 101/415.1 |
| 2,946,282 | 7/1960 | Harless | 101/415.1 |
| 2,986,085 | 5/1961 | Johnson | 101/415.1 X |
| 3,008,410 | 11/1961 | Bryer | 101/415.1 |
| 3,166,012 | 1/1965 | Hantscho | 101/415.1 X |
| 3,332,346 | 7/1967 | Luehrs | 101/415.1 |
| 3,727,551 | 4/1973 | Kostas | 101/415.1 |

FOREIGN PATENT DOCUMENTS

| | | | |
|---|---|---|---|
| 2,126,941 | 11/1972 | Germany | 101/415.1 |
| 617,936 | 8/1935 | Germany | 101/415.1 |

*Primary Examiner*—J. Reed Fisher
*Attorney, Agent, or Firm*—Allison C. Collard

[57] ABSTRACT

A cylinder for clamping printing plates for photogravure printing wherein the cylinder has a longitudinal bore comprising at least one clamping spindle with a surface for receiving the printing plate ends said at least the clamping spindle runs on the radius of the surface of the cylinder, wherein in the clamping and closing position, the cylinder bore is closed. The clamping spindle is flattened on the inside and loosely supports a continuous cylindrical cup which is positioned in the axis radial in the clamped and locked position of the clamping spindle. There is a tension spring and ball disposed in a lateral bore of the clamping spindle for supporting the spindle with respect to the cylinder bore wall at the side which is opposite to the advancing side of the cylinder.

7 Claims, 2 Drawing Figures

CYLINDER FOR CLAMPING PRINTING PLATES

Figure 1:
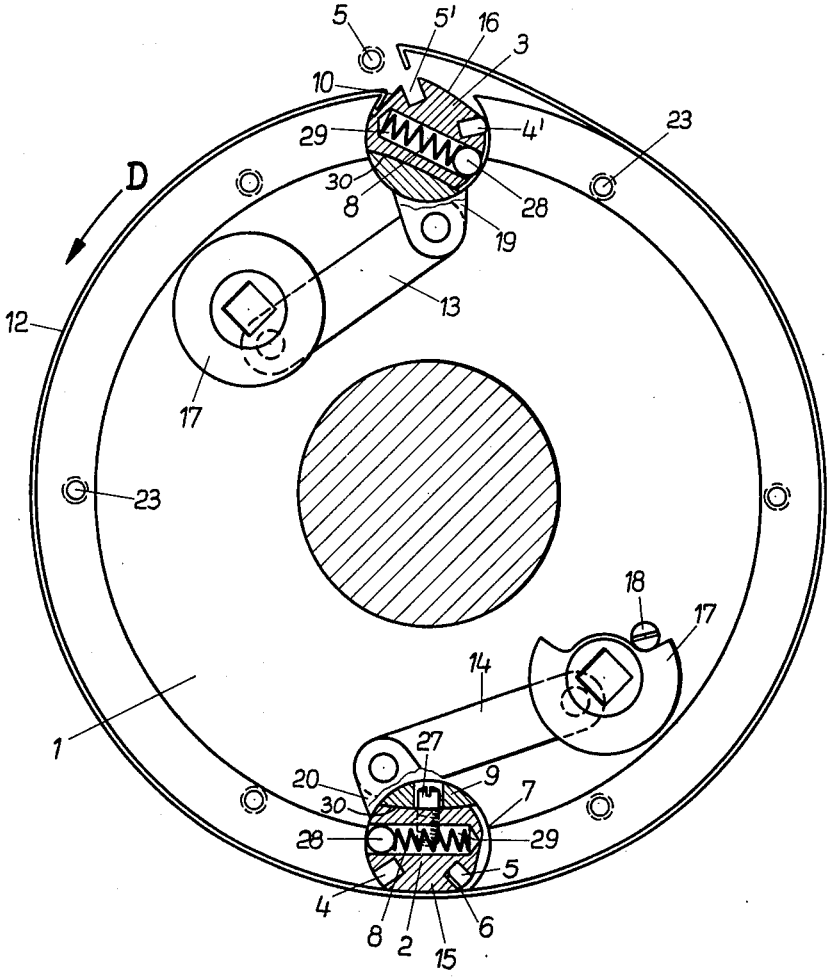

The present invention relates to a cylinder for mounting printing plates for photogravure printing. The advantage of printing plates, which may consist of copper, steel-copper or steel-nylon, is in their simple and fast manufacture, and their rather easy handling.

Such a cylinder is hitherto only available in photogravure sheet printing presses, wherein the plates encompass half of the circumference of the cylinder.

It is therefore an object of the present invention to provide a cylinder which may be used for an all around printing, so that the useable printing surface is enlarged. The technical difficulty in solving this object of the invention is that the cylinder is constantly supplied with ink over its total surface during the printing process, so that the cylinder must be completely sealed at its front edges, as well as on the circumferential surface. Therefore, the cylinder used for printing plates in a relief printing process with the open clamping actuating elements, retaining pawls and mounting slots are not useable for the photogravure printing process.

In accordance with the invention, a clamping spindle is provided with a surface for the ends of the printing plates which covers the cylinder bore for the clamping spindle in the clamping and closed position and which lies flush with the upper circumferential surface of the cylinder. This provides the basis for a steady interference free rolling over by the counter pressure cylinder and the wiper, as well as an inking roller. The above device is also the basis for a safe and positive sealing, which can be easily controlled under a continuous alternating bending stress. Furthermore, an easy and rapid exchange of the printing plates is assured. Two such clamping spindles may be provided on the cylinder diametrically disposed of each other, so that the total cylinder circumference may be covered by means of two printing plates.

In order to absorb the high pressure transmitted to the spindle by the counter pressure cylinder, the clamping spindle is flattened on the inside in accordance with the invention, and carries a loose or slack continuous calotte or, elongated, generally cylindrical, segment-shaped member having a generally c- or cup-shaped, cross-section, the radial axis of which defining the engaging peripheral face thereof, is coaxial with the axis of the cylinder when the clamping spindle is in its clamped and closed position. This cylinder callote transmits the contact pressure centrally in the direction of the cylinder axis.

In accordance with the invention, the clamping spindle has a minutely smaller cross section than the encompassing cylinder bore and is supported with respect to the cylinder bore wall at the side which is opposite to the advanced side of the cylinder by a plurality of tension springs or balls, or the like, which are mounted in a plurality of bores in the clamping spindle. The difference in cross section between the cylinder and the clamping spindle may be as small as about 2mm. Thus, small differences may be compensation for when the edges are cut, as well as after the plate material has expanded at the start of printing.

In accordance with the invention, the clamping spindle is provided with two longitudinal grooves for receiving sealing means at both sides of its cover surface and at a small distance away from the same. One of these sealing means receives the advancing end of the printing plate. Furthermore, the sealing means also seal the cylinder bore for the clamping spindle with respect to the cylinder surface.

The clamping actuating elements are mounted in the inside of the cylinder at the front edges and are closed by a closing plate or cover by using elastic sealing rings which seal the engaging joints. Such sealing rings are embedded by protective spaces on three sides, and may therefore be of elastic material which is not subject to wear due to the alternating bending stress transmitted on these sealing rings.

Other objects and features of the present invention will become apparent from the following detailed description when taken in connection with the accompanying drawings which disclose several embodiments of the invention. It is to be understood that the drawings are designed for the purposes of illustration only, and are not intended as a definition of the limits and scope of the invention disclosed.

Figure 2:
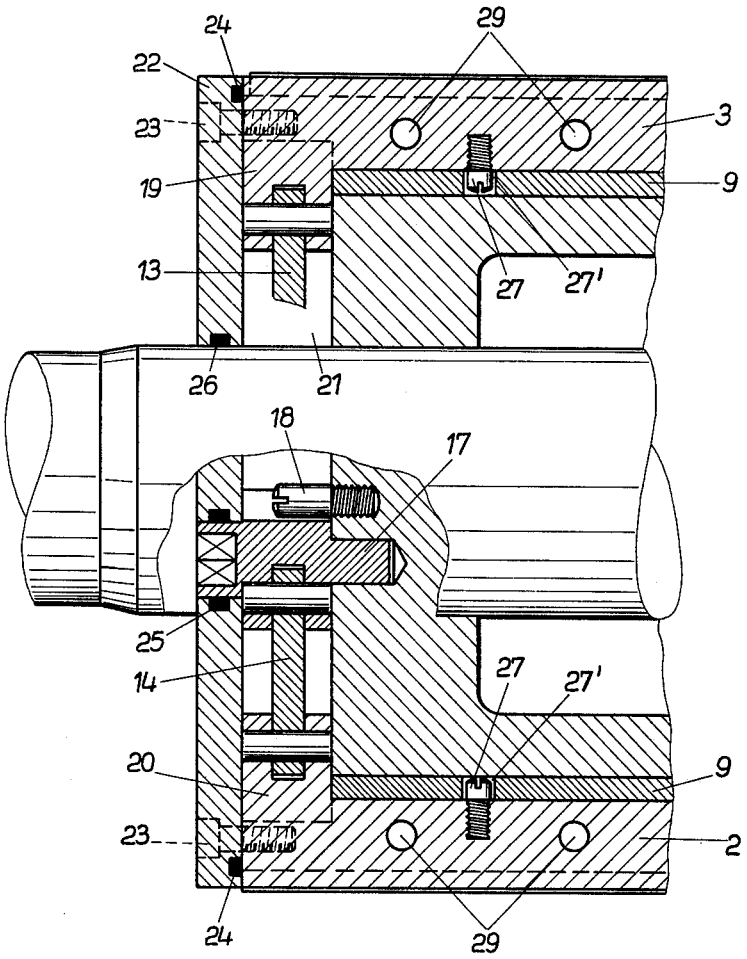

In the drawings, wherein similar reference numerals denote similar elements throughout the several views:

FIG. 1 is a side view partly in cross section with cut clamping spindles showing the invention; and FIG. 2 is a longitudinal sectional view through one of the front surfaces.

Referring to FIG. 1 there is shown a clamping spindle 2 in a clamped position and clamping spindle 3 in open position. As can be seen on clamping spindle 2, the inserted sealing cords 4 and 5 seal the space between clamping spindles 2 and 3 together with the associated cylinder bores in the clamped and locked or closed position of the spindle, so that the sealing cords are mounted in continuous grooves 4' and 5'. The mounting position is shown on clamping spindle 3. Thus, sealing cord 5 serves to clamp the printing plate in clamping spindles 2 or 3 when they are mounted. Furthermore, longitudinal groove 5' also serves to clamp the front edge of the printing plate against cylinder 1, so as to obtain a registerable abutment of the printing plate, so that the abutment joint of the two plate ends may be securely sealed. The sealing cord preferable consists of a foamed elastomer with open pores, which permits adhering of a filler material 6 for closing any eventual open space.

When the edges of the printing plates are cut, small changes as well as after-expansions of the plate materials at the beginning of printing are compensated for in a slot 7 which is provided between the clamping spindle and its associated cylinder bore. Tension springs 8, which are mounted in lateral bores 29 push balls 28 and move clamping spindles 2 and 3 from the wall of the cylinder bore and thereby assure a firm seating of the plate. The clamping spindles support an elongated, generally cylindrical, segment-shaped cylinder calotte 9 having a generally c- or cup-shaped cross-section by means of pins 27 which loosely engage bores 27', whereby the engaging slightly convexly-shaped face of the calotte defines a radius which emanates from the center of the cylinder when the spindle is in a clamping position. Cylindrical calotte 9 forms a solid bracing support for clamping spindles 2 and 3 against the pressure of the counter pressure cylinder. Each face 10 of clamping spindles 2 and 3 permits an easier mounting of the rear end of the plates in the rotating direction D. The turning of clamping spindles 2 and 3 for clamping purposes or releasing purposes of plates 11 and 12 is done in the usual manner over connecting rods 13 and 14 from an eccentric bolt. These rods form an exaggerated dead point position in the closing position so as to absorb the high tension. Connecting rods 13 and 14 have a defined length which fixes the exact position of cover surfaces 15 and 16 so that they lie flush with the circumferential surface of the cylinder, when the spindles are in a clamping position. Eccentric bolt 17 is provided with a limit abutment 18.

In FIG. 2, it can be seen that actuating arms 19 and 20 of clamping spindles 2 and 3 are inserted into a hollow space 21 in the front surface of cylinder 1. Also shown is how connecting rods 13 and 14 are installed as well as eccentric bolt 17 with limit abutment 18. Cover plate 22 seals all clamped actuating elements against ink entering in hollow space 21. For assembly and maintenance purposes, coverplate 22 can be easily removed by loosening screws 23. The seals are made of elastic sealing rings 24, 25 and 26 which can be easily replaced, if need be. Cover plate 22 has the same cross section as the cylinder with the mounted winding plates in order to permit a jolt free or smooth transition of printing and counter pressure cylinder. For the same purpose it is recommended that the longitudinal axis of the clamping spindles be offset at about 4° with respect to a plane intersecting the axis of the cylinder, which requires a corresponding angling of the edges of the printing plates when the wiper is in a parallel axis position, relative to the axis of the cylinder. The flattening 30 of the clamping spindle is concave with respect to convexly shaped engaging face of cylinder calotte 9.

While only a few embodiments of the present invention have been shown and described, it will be obvious to those skilled in the art that many changes and modifications may be made thereunto without departing from the spirit and scope of the invention.

What is claimed is:

1. A cylinder for clamping printing plates for photogravure printing, wherein the cylinder has at least one longitudinally-extending, bore opening onto the cylindrical, circumferential surface thereof, comprising:

at least one clamping spindle mounted for reciprocable-rotatable movement within said at least one bore of said cylinder for movement between a release position and a clamping position, said spindle having a longitudinally-extending, generally cylindrical, peripheral surface portion, which lies flush with the circumferential surface of said cylinder, when said spindle is in a clamping position, and a pair of longitudinally-extending grooves disposed on opposite sides of said cylindrical surface portion, one of which serves to retain one end of a printing plate and both of which serve to retain sealing means, said spindle also including a generally flattened, peripheral surface portion adjacent to the side of said one-end retaining groove thereof, opposite the cylindrical surface portion, for retaining in cooperation with the surface of said bore of said cylinder, the other end of the printing plate; and sealing means disposed with said grooves of said spindle for effecting sealing engagement of said spindle within said bore of said cylinder.

2. The cylinder according to claim 1, wherein said at least one clamping spindle includes a longitudinally-extending, second generally flattened, peripheral surface portion opposite said cylindrical surface portion thereof, and an elongated, longitudinally-extending, generally cylindrical, segment-shaped member having a cylindrical, peripheral surface portion, said flattened, peripheral surface portion of said member being supported in abutting relationship against said flattened, peripheral surface portion of said spindle.

3. The cylinder according to claim 2, wherein said second flattened, peripheral surface portion of said spindle is slightly concavely-shaped and said flattened, peripheral surface portion of said member is complementary, slightly convexly-shaped.

4. The cylinder according to claim 1, wherein said at least one clamping spindle has a slightly smaller cross-section than the encompassing cylinder bore, a tension spring and ball disposed in a lateral bore of said at least one clamping spindle for supporting the spindle with respect to the cylinder bore wall, said lateral bore opening onto the peripheral surface of said spindle adjacent to the side of the other of said grooves opposite the cylindrical surface portion.

5. The cylinder according to claim 1 additionally including clamp actuating elements mounted within said cylinder adjacent to one end thereof and coupled to said at least one spindle for effecting reciprocable-rotatable movement of said spindle between said release and clamping position thereof, and a cover plate for closing said one end of said cylinder, said cover plate additionally including sealing rings for effecting sealing engagement thereof with said end of said cylinder.

6. The cylinder according to claim 1, wherein the longitudinal axis of said at least one clamping spindle is offset relative to a plane intersecting the axis of said cylinder by up to about 4°.

7. The cylinder according to claim 1, wherein said cylinder has a second, longitudinally-extending bore opening onto the cylindrical surface thereof, displaced 180° from said at least one bore thereof, and said cylinder additionally includes a second spindle mounted with said second bore, and sealing means disposed within said grooves of said second spindle, for effecting sealing engagement of said second spindle within said second bore of said cylinder.

* * * * *